US008540093B2

(12) United States Patent
Paral

(10) Patent No.: US 8,540,093 B2
(45) Date of Patent: Sep. 24, 2013

(54) MIDDLE BUFFER COUPLING FOR RAIL-BOUND VEHICLES

(75) Inventor: Thomas Paral, Eppelheim (DE)

(73) Assignee: Era-Contract GmbH, Bretten (DE)

( * ) Notice: Subject to any disclaimer, the term of this patent is extended or adjusted under 35 U.S.C. 154(b) by 250 days.

(21) Appl. No.: 13/120,350

(22) PCT Filed: Sep. 22, 2009

(86) PCT No.: PCT/EP2009/062274

§ 371 (c)(1),
(2), (4) Date: Mar. 22, 2011

(87) PCT Pub. No.: WO2010/034719

PCT Pub. Date: Apr. 1, 2010

(65) Prior Publication Data

US 2011/0174755 A1 Jul. 21, 2011

(30) Foreign Application Priority Data

Sep. 23, 2008 (DE) ..... 10 2008 048 440

(51) Int. Cl.
*B61G 5/06* (2006.01)

(52) U.S. Cl.
USPC ..... 213/1.3; 213/1.6; 213/75 R; 213/100 R

(58) Field of Classification Search
USPC ..... 213/1.3, 1.6, 75 R, 100 R
See application file for complete search history.

(56) References Cited

U.S. PATENT DOCUMENTS

| | | | | |
|---|---|---|---|---|
| 3,251,480 | A * | 5/1966 | Willison et al. | 213/1.3 |
| 3,842,987 | A * | 10/1974 | Prada | 213/1.3 |
| 4,284,311 | A * | 8/1981 | Forster et al. | 439/34 |
| 4,403,705 | A * | 9/1983 | Ernst et al. | 213/1.3 |
| 4,957,208 | A * | 9/1990 | Ta | 213/1.3 |
| 6,264,048 | B1 * | 7/2001 | Ramnialis et al. | 213/1.3 |
| 7,345,639 | B2 * | 3/2008 | Prill et al. | 343/711 |
| 7,458,477 | B2 * | 12/2008 | Jones | 213/1.3 |
| 2004/0129664 | A1 * | 7/2004 | Uneme et al. | 213/1.3 |
| 2010/0044333 | A1 * | 2/2010 | Marvel et al. | 213/1.3 |
| 2010/0326942 | A1 * | 12/2010 | Dahlstrom et al. | 213/1.3 |
| 2011/0079167 | A1 * | 4/2011 | Yao | 105/1.4 |
| 2011/0174755 | A1 * | 7/2011 | Paral | 213/75 R |

FOREIGN PATENT DOCUMENTS

| | | | |
|---|---|---|---|
| DE | 1819858 | U | 10/1960 |
| DE | 1810595 | A1 | 6/1970 |
| DE | 2448889 | A1 | 4/1975 |
| DE | 2922439 | A1 | 12/1980 |
| FR | 2217995 | A | 9/1974 |
| WO | 2005113313 | A1 | 12/2005 |
| WO | WO 2005113313 | A1 * | 12/2005 |

* cited by examiner

*Primary Examiner* — Jason C Smith
(74) *Attorney, Agent, or Firm* — McCormick, Paulding & Huber LLP

(57) ABSTRACT

What is described is a middle buffer coupling for rail-bound vehicles, comprising two coupling halves (2, 2') to be coupled together attached to vehicle parts (A, B), each of said coupling halves (2, 2') comprising a coupling rod (8, 8') with a coupling head (12, 12'), and comprising a connecting element (16) for manually connecting the two coupling heads (12, 12'). Disposed at each coupling head (12, 12') is an electrical contact element (32, 34) for contacting with the contact element of the other respective coupling head (12, 12') when the two coupling halves (2, 2') are coupled. Routed within each coupling rod (8, 8') are electrical lines (18, 18') that lead from the contact elements (32, 34) of the associated coupling head (12, 12') to the vehicle part (A, B) to which the coupling halves (2, 2') comprising said coupling rods (8, 8') are attached, respectively.

15 Claims, 5 Drawing Sheets

MIDDLE BUFFER COUPLING FOR RAIL-BOUND VEHICLES

CROSS REFERENCE TO RELATED APPLICATIONS

This application is entitled to the benefit of and incorporates by reference essential subject matter disclosed in International Patent Application No. PCT/EP2009/062274 filed on Sep. 22, 2009 and German Application No. 10 2008 048 440.7 filed on Sep. 23, 2008.

FIELD OF THE INVENTION

The present invention relates to a middle buffer coupling for rail-bound vehicles.

BACKGROUND OF THE INVENTION

A middle buffer coupling for rail-bound vehicles is particularly used for coupling individual railway carriages together which do not have a drive of their own. In this function, such a middle buffer coupling is also referred to as an intermediate coupling or a close coupling. In contrast to automatic railway couplings, mechanical intermediate or close couplings are manually coupled together via a suitable connecting element.

Electric currents and signals are also transmitted between the carriages that are coupled together. For this, connecting cables, also referred to as jumper cables, are usually used, which are to be inserted manually into connections attached to the carriages. As a comparatively large number of connecting cables is often required for the power and signal transmission, the manual insertion and removal of the connecting cables is laborious and time-consuming. In an emergency, e.g. in case of an accident, the connecting cables are often forcibly cut and destroyed by the rescue personnel, as a manual removal would be too time-consuming. It is further disadvantageous that the connecting cables known from prior art have to be housed in comparatively expensive protection sleeves to protect them from harsh environmental conditions.

An alternative solution is to provide a separate electrical coupling for the power and signal transmission in addition to the mechanical middle buffer coupling. Such a solution is described in DE 29 22 439 A1. Therein a mechanical middle buffer coupling is provided, the two coupling halves of which are connected together by a shell-type sleeve. Below the mechanical middle buffer coupling a support is positioned, on which a cable coupling is led. This known coupling system is comparatively complex as it comprises two separate couplings, i.e. an electrical and a mechanical coupling.

From DE 1 810 595 a middle buffer coupling is known. This middle buffer coupling comprises air lines or electrical lines which are led out of the respective coupling rod shortly behind a shell-type sleeve with which the coupling heads of the two coupling halves are connected together.

It is the object of the present invention to further develop a mechanical, manually operable middle buffer coupling such that it also allows the secure transmission of electrical currents and signals between the vehicle parts to be coupled together with minimal technical effort.

The present invention is directed to a middle buffer coupling for rail-bound vehicles comprising two coupling halves to be coupled together attached to respective vehicle parts. Each of the coupling halves comprises a coupling rod with a coupling head. The coupling also comprises a connecting element for manually connecting the two connecting heads.

An electrical contact element is disposed at each coupling head for contacting with the contact element of the other respective coupling head when the two coupling laves are coupled. Each coupling rod is formed to be hollow and electrical lines are routed within each coupling rod such that the electrical lines are positioned completely within the respective coupling rod and lead from the contact elements of the associated coupling head to the vehicle part to which the coupling halves comprising said coupling rods are attached.

SUMMARY OF THE INVENTION

The present invention provides a mechanical, manually operable middle buffer coupling that allows the same transmission of electrical currents and signals between the vehicle parts to be coupled together with minimal technical effort.

Thus, in the middle buffer coupling according to the invention, a mechanical coupling and an electrical coupling are integrated. The coupling rods, which are part of the mechanical coupling, according to the invention, also serve as housings for the electrical lines, which conduct the electrical currents e.g. for the signal and power transmission from the contact elements into the respective vehicle part.

As the electrical lines are routed within the coupling rods, they are in contrast to the connecting lines used in the prior art and are not subjected to harsh environmental conditions. Therefore there is no need for expensive protection sleeves, in which the lines are led. Furthermore, the lines routed within the coupling rods are not subjected to mechanical stress. Therefore it is not important that the lines are formed particularly flexibly. Rather, the lines can be routed rigidly and thus more cost-efficiently than in the prior art within the coupling rods.

In particular, the lines which are already present in the vehicle parts to be coupled can be easily led through the coupling rods to the contact elements. Expensive special solutions, as they are needed in the prior art, are not required anymore. The measures, which are necessary with respect to the Electromagnetic Compatibility, abbreviated EMC, can be taken within the coupling rod, which presents a system protecting against external influences, with lower technical effort than it would be the case for flexible connecting lines used in the prior art. Thus within the coupling rod e.g. partitions or shieldings for groups of lines can be provided to satisfy EMC requirements.

A further important advantage of the invention is that due to the integration of the mechanical and electrical coupling only one single coupling process is necessary. This facilitates the operation of the coupling substantially.

The integration of the mechanical and electrical coupling according to the invention is also advantageous with respect to the weight and the required installation space. As practically no wear occurs on the electrical lines led within the coupling rods, consequently also the maintenance of the coupling involves less effort.

In an advantageous further embodiment, each coupling head has a contact carrier at the face side thereof facing the respective other coupling head, in which contact carrier the contact elements are arranged. In this case the contact carrier of one of the two coupling heads is preferably formed as male connector and the contact carrier of the other coupling head is preferably formed as female connector for receiving the male connector. The contact carriers can thus easily be stuck onto one another in the coupling direction to establish a secure electrical contact between the contact elements.

In an advantageous embodiment, the contact elements of one of the two coupling heads are mounted in axially resilient manner in the contact carrier and are biased in the coupling direction, while the contact elements of the other coupling head are rigidly mounted in the contact carrier. If the coupling heads are connected together, the rigidly mounted contact elements push the contact elements mounted in axially resilient manner against the bias acting in the coupling direction into the contact carrier. The bias provides a secure electrical contact between the contact elements.

In a further preferred embodiment, the contact carrier of the one coupling head comprises a first plate having a plurality of axial first bores and a second plate attached to the first plate having a plurality of axial second bores aligned to the first bores. The diameter of the respective second bore is smaller than the diameter of the first bore, to which this second bore is aligned. In the first bores respectively one of the contact elements and a biasing element is arranged. The respective contact element includes an annular abutment and a contact head adjacent to the abutment, which is led through the second associated bore. The biasing element pushes the abutment in the coupling direction onto the second plate. In this embodiment the respective contact element mounted in axially resilient manner is adjacent to the second plate with the annular abutment thereof, when said contact element is not impinged, i.e. the contact element forming the associated mating contact of the other coupling head does not press onto said contact element. If the coupling heads are connected together, the mating contact presses the contact element mounted in axially resilient manner against the biasing force exerted by the biasing element into the first bore.

Preferably each coupling head has an annular flange attached to the free end of the coupling rod. In this case the connecting element is e.g. formed as shell-type sleeve, which surrounds the annular flanges lying adjacent to each other to connect the two coupling heads. The shell-type sleeve consists e.g. of two uniform shell portions which can be connected together, e.g. be screwed together.

In a further embodiment, at least a part of the contact elements of each coupling head is disposed at the outer surface of the annular flange, while the shell-type sleeve includes bridge contacts at the inner surface thereof, which bridge contacts contact the contact elements disposed at the outer surfaces of the annular flanges. In this embodiment the shell-type sleeve is part of the electrical coupling by electrically connecting via the bridge contacts thereof the contact elements assigned to one another in pairs of the coupling heads. By using the outer surfaces of the annular flanges for housing electrical contact elements, also comparatively small coupling heads can be provided with a large number of contact elements. This contributes to a compact structure of the middle buffer coupling.

The contact elements arranged at the outer surface of the annular flange and/or the bridge contacts arranged at the inner surface of the shell-type sleeve are preferably formed as contact springs. The contact springs ensure a particularly reliable electrical contact.

Advantageously, the electrical lines are crimped onto the contact elements. Thereby transition resistances between the lines and the contact elements are kept low.

A part of the contact elements of each coupling head can be intended for power transmission and another part for signal transmission. If the contact elements are arranged at the outer surface of the annular flange as well as at the face surface of the respective coupling head, it can be advantageous to arrange one part of the contact elements only at the outer surface of the annular flange and the other contact elements only at the face surface. Thus the contact elements arranged at the face surface contact the contact elements arranged at the other coupling head directly, while the contact elements arranged at the outer surface of the annular flange contact the contact elements arranged at the other coupling head via the bridge contacts arranged at the inner surface of the shell-type sleeve. If for example, due to the interposition of the bridge contacts losses of power are to be feared, it is more efficient to arrange the contact elements determined for the power transmission at the face surface of the respective coupling head. Contrariwise, it is also conceivable to transmit particularly sensitive signals or functionally important signals directly via the face surfaces of the coupling heads.

In a further advantageous embodiment, each coupling half comprises a housing part mounted in an articulated manner to the respective vehicle part, in which the associated coupling rod is resiliently received. In this embodiment the lines are preferably led through the coupling rod and the housing part into the vehicle part. The electrical lines are then completely protected against external influences by the coupling rod and the housing part.

Preferably a buffer device is arranged in each coupling rod and/or in each housing part. Examples for such a device are tension/compression springs, gas-pressure springs, hydraulic springs, pneumatic shock absorbers and friction shock absorbers as well as combinations of the aforementioned devices.

In an advantageous further embodiment, each coupling head has at least one annular portion extending in the coupling direction at the face surface thereof, the annular height of which measured in the coupling direction varies in the circumferential direction such that the annular portion fits on the annular portion of the respective other coupling head only in precisely one rotation position of the coupling heads with respect to each other. The annular portions thus form a security against rotation, i.e. they ensure that the coupling heads can only be connected together in the correct positions.

With the annular portions, centering of the coupling heads is also possible. Alternatively or additionally centering can also be realized via a conical, axial projection which is preferably arranged in the center of the face surface of the one coupling head and a corresponding conical, axial recess which is positioned at the face surface of the other coupling head and fittingly receives the projection during coupling.

BRIEF DESCRIPTION OF THE DRAWINGS

The invention will be explained in more detail in the following on the basis of the Figures, wherein.

DETAILED DESCRIPTION OF THE DRAWINGS

Figure 1:
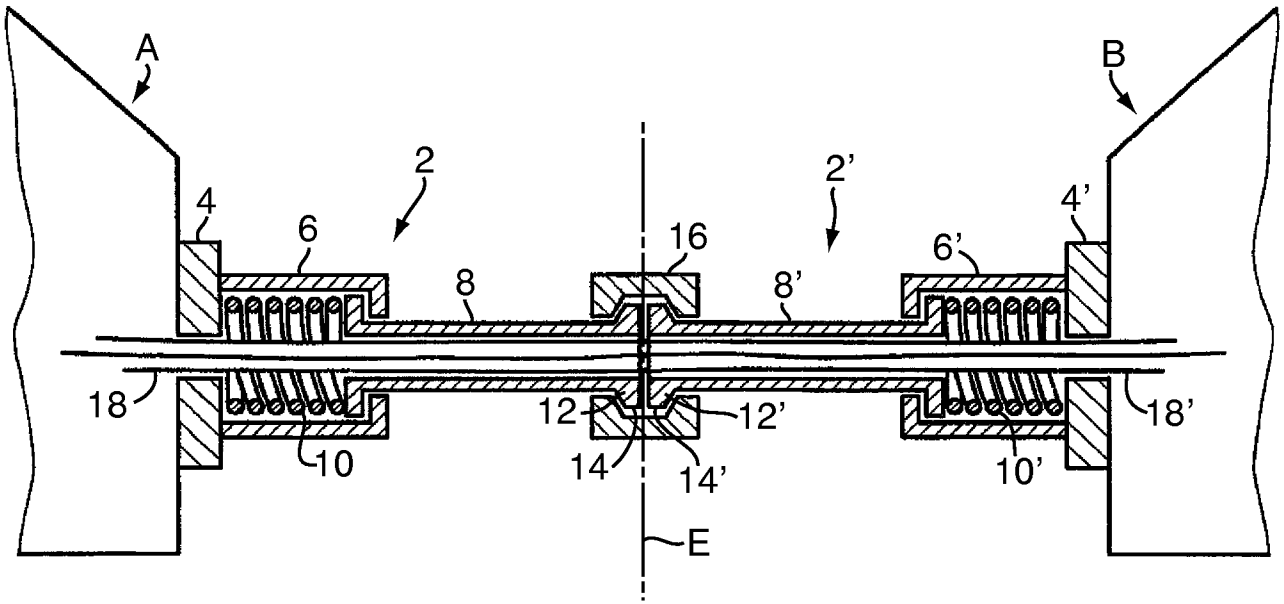
FIG. 1 shows a schematic illustration of a middle buffer coupling according to the invention.

FIG. 1 shows a manually operable middle buffer coupling, also referred to as intermediate coupling or close coupling. Thereby FIG. 1 is a simplified, schematic illustration which serves to explain functionally important features of the middle buffer coupling according to the invention.

The middle buffer coupling according to FIG. 1 comprises two substantially structurally identical coupling halves 2 and 2' which are attached to a vehicle A or B and are to be coupled together. The coupling halves 2 and 2' comprise respectively one flange 4 or 4', a housing part 6 or 6' and a coupling rod 8 or 8'. The respective housing part 6, 6' is mounted in an articulated manner via a bearing, not illustrated in detail, to the flange 4, 4'. The housing part 6, 6' can be pivoted horizontally and vertically via the articulated mounting at the flange 4, 4'.

In each housing part 6, 6', a buffer device 10 or 10' is positioned which serves to absorb tensile and/or impact forces acting on the coupling half 2, 2'. The buffer device 10 can e.g. be formed as tension/compression spring, gas-pressure spring, hydraulic spring, pneumatic shock absorber or friction shock absorber. In the case of the embodiment shown in FIG. 1, the buffer device 10, 10' is positioned within the housing part 6, 6'. However, it can also be arranged in an appropriate place within the coupling rod 8, 8'.

Each coupling rod 8, 8' has a coupling head 12 or 12' at the free end thereof, i.e. the end facing the other coupling rod 8, 8'. In the present embodiment, an annular flange 14 or 14' is disposed at each coupling head 12, 12'. In order to couple the two coupling halves 2, 2' together, the coupling heads 12, 12' are brought into contact with the front surfaces thereof and then connected together with a two-part shell-type sleeve 16. The face surfaces of the coupling heads 12 are then positioned in a coupling plane referred to with E in FIG. 1.

When the two coupling halves 2, 2' are coupled together, electrical contact elements contact one another pairwise, which electrical contact elements are arranged at the face surfaces of the coupling heads 12, 12' and are not illustrated in detail in FIG. 1. Thereby to each contact element of the one coupling head 12 a contact element of the other coupling head 12' is assigned. The contact elements serve to connect the two coupling halves 2, 2' electrically together.

The coupling rods 8, 8' are formed to be hollow, so that electrical lines 18 leading out of the vehicle A or the vehicle B to the electrical contact elements of the associated coupling half 2, 2' can be routed within the respective coupling rod 8, 8'. In the respective vehicle A, B, the lines 18, 18' are connected to electrical apparatuses, e.g. batteries, drive units, signal processing apparatuses etc. To simplify matters, in FIG. 1 only respectively three lines 18, 18' are illustrated. In fact the number of lines 18 or 18' is equal to the number of contacts which are provided at the respective coupling head. This number is usually considerably larger than three (cf. e.g. FIG. 2).

In the present embodiment, the lines 18 are installed completely within the respective coupling rod 8, 8' and thus also completely within the respective housing part 6, 6'.

Figure 2:
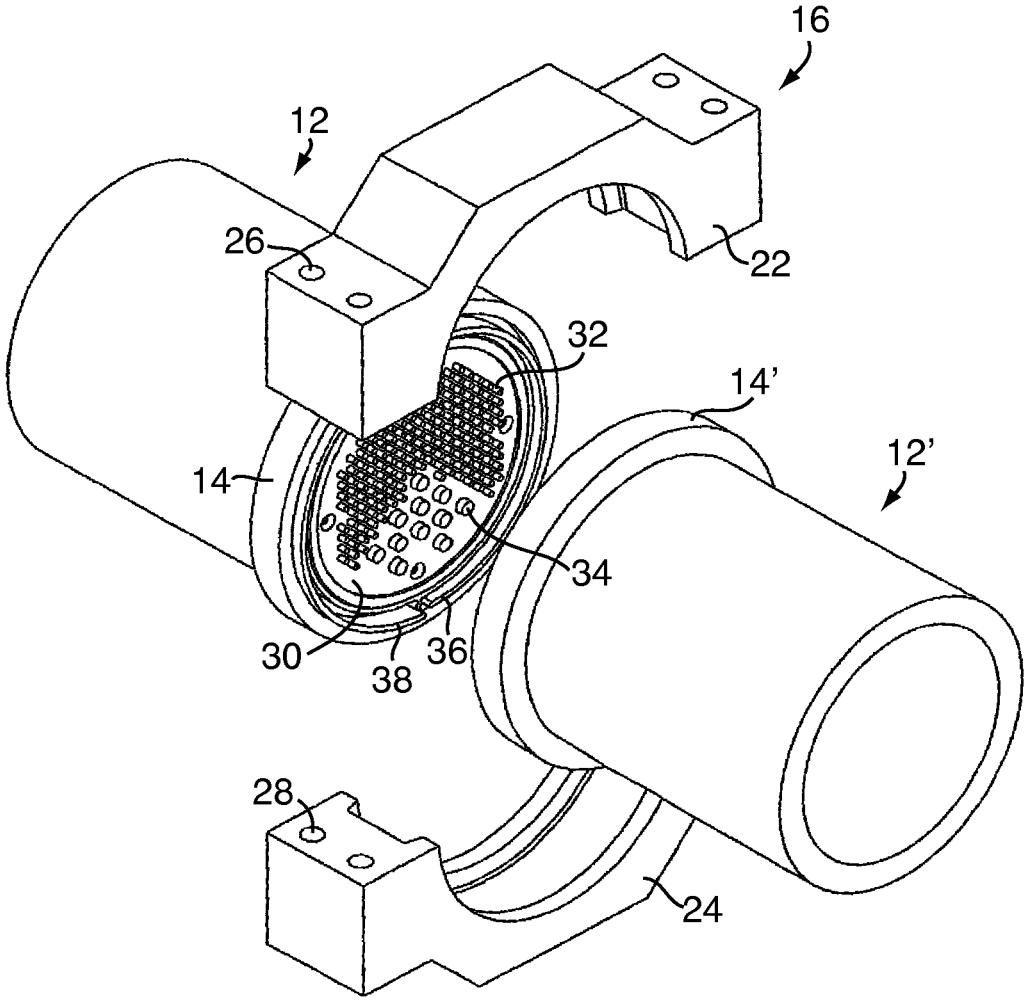
FIG. 2 shows a perspective view showing two coupling heads and a shell-type sleeve.
Figure 3:
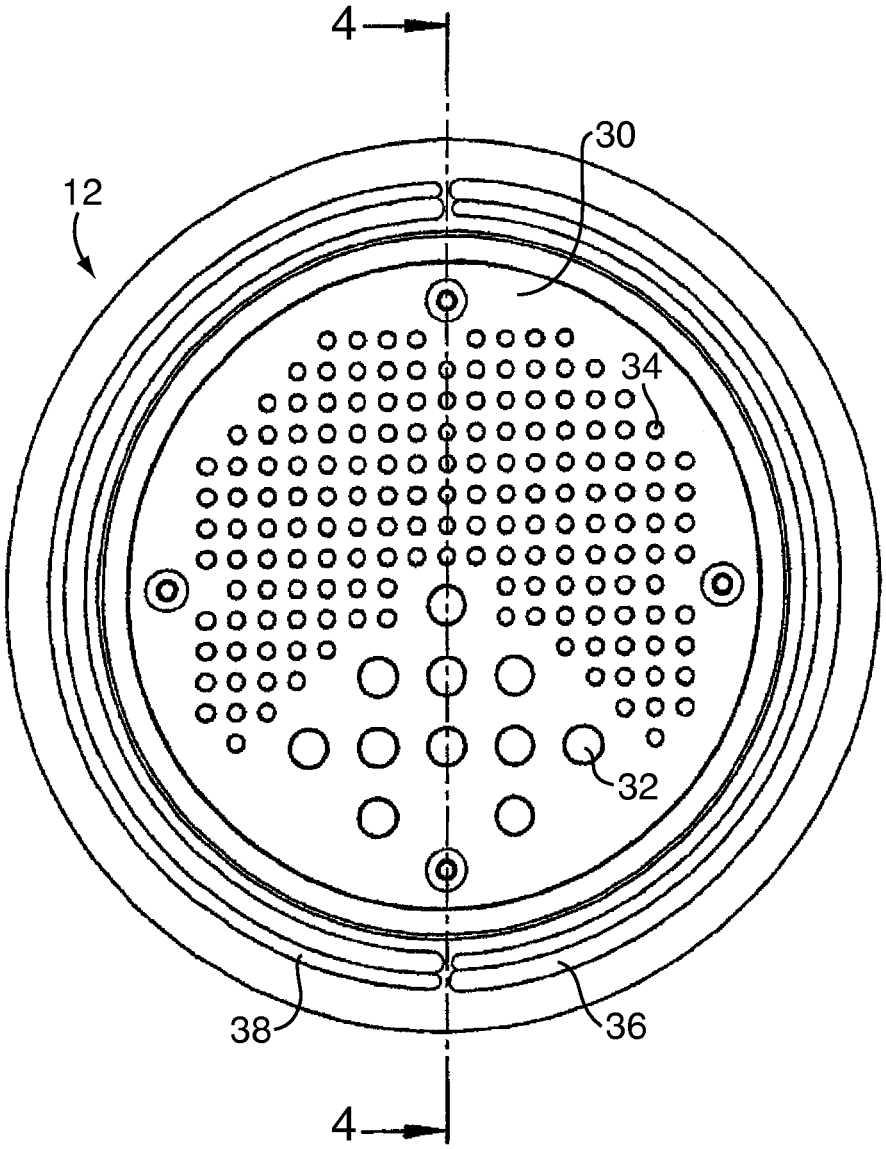
FIG. 3 shows a top view of a coupling head shown in FIG. 2.
Figure 4:
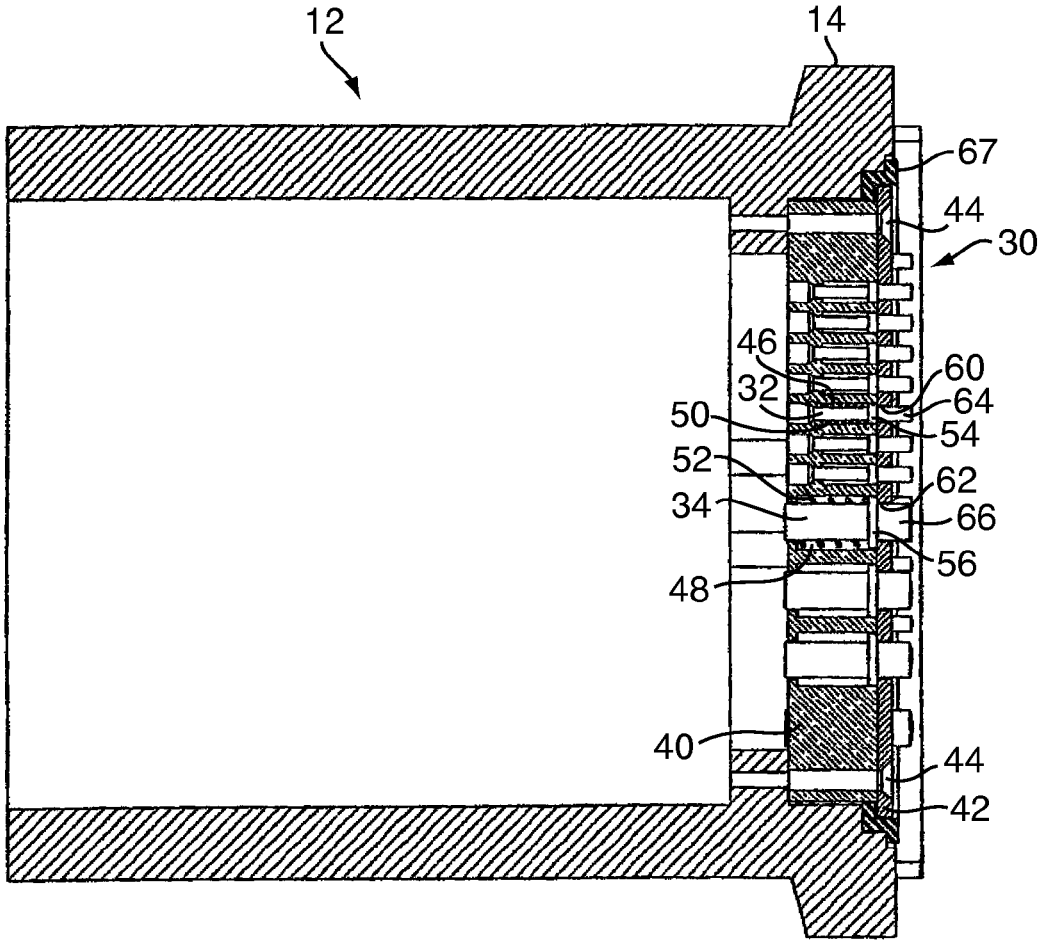
FIG. 4 shows a section along the line A-A shown in FIG. 3.

In the FIGS. 2 to 4, a particular embodiment of the middle buffer coupling according to the invention is shown.

FIG. 2 shows the coupling heads 12, 12' as well as the shell-type sleeve intended for connecting the coupling heads 12, 12' together. In this embodiment, the shell-type sleeve 16 consists of two substantially uniform shell portions 22 and 24 which are put on the annular flanges 14, 14' from above and below and then connected together. The shell portions 22 and 24 are shaped correspondingly to the annular flanges 14, 14'. This means that the shell portions 22 and 24 in the assembled state lie flush against the outer surfaces of the annular flanges 14, 14', and thus connect the two coupling heads 12, 12' substantially non-positively and positively. To connect the two shell portions 22 and 24 together, through bores 26 are formed in the one shell portion 22, through which screws, not shown, are led, which are screwed into threads 28 formed at the other shell portion 24.

In the present embodiment, contact carriers are positioned at the face sides facing one another of the coupling heads 12, 12', of which contact carriers in FIG. 2 only the contact carrier, referred to with 30, attached to the coupling head 12 is illustrated. Electrical contact elements 32 and 34 are arranged at the contact carrier 30. The contact elements 32 are intended for the signal transmission, while the contact elements 34 are intended for the power transmission. At the not shown contact carrier, which is attached to the other coupling head 12', corresponding contact elements are positioned, which contact respectively one of the contact elements 32, 34, when the two coupling heads 12, 12' are connected together by means of the shell-type sleeve 16.

At the face sides of the coupling heads 12, 12' facing one another respectively a plurality, e.g. two, annular portions are positioned, of which only the annular portions referred to with 36 and 38 of the coupling head 12 are illustrated in FIG. 2.

The annular portions 36, 38 of the coupling head 12 and the corresponding not shown annular portions of the other coupling head 12' are intended to bring the coupling heads 12, 12' in the correct positions, secured against rotation and centered into contact with one another. To this end, the annular portions 36, 38 respectively have an annular height measured in the coupling direction, which height varies in the circumferential direction. The varying annular heights of the annular portions 36, 38 of the one coupling head 12 and the varying annular heights of the not shown annular portions of the other coupling head 12' are adjusted to one another such that the annular portions are fitted flush with one another only in precisely one rotation position of the coupling heads 12, 12'. Only in this rotation position also the contact elements 32, 34 of the coupling head 12 contact the not shown contact elements of the coupling head 12' functionally accurately.

In FIG. 3 the contact carrier 30 of the coupling head 12 is shown in the top view. As illustrated in FIG. 3, the contact elements 34 intended for power transmission are at a larger distance from one another than the contact elements 32 intended for signal transmission. Further the contact elements 32 and 34 (and also the contact elements arranged at the other coupling head 12') constitute a rotationally asymmetrical contact arrangement. This contact arrangement ensures that the contact elements 32, 34 of the one coupling head 12 and the contact arrangement of the other coupling head 12' can only contact one another functionally accurately in precisely one rotation position.

FIG. 4 shows the coupling head 12 in a section along the line A-A illustrated in FIG. 3.

As shown in FIG. 4, the contact carrier 30 consists of a first plate 40 and a second plate 42. The plates 40 and 42 are attached at the coupling head 12 via screws 44.

The first plate 40 includes first axial bores 46 and 48, in which respectively one of the contact elements 32 or one of the contact elements 34 as well as a spring 50 or 52 are arranged. As can be taken from FIG. 4, each contact element 32, 34 has an annular abutment 54 or 56, which is pressed onto the second plate 42 by the spring 50 or 52.

The second plate 42 includes second axial bores 60, 62 which are respectively aligned to one of the first bores 46, 48. Thereby the diameters of the second bores 60, 62 are dimensioned such that only the coupling heads referred to with 64 or 66 of the contact elements 32 or 34, however not the annular abutments 54, 56, can pass through the second bores 60, 62. Thus, the second plate 42 constitutes a counter plate which holds the contact elements 32, 34 in the first plate 40.

A seal 67 is positioned between the inner surface of the annular flange 14 and the contact carrier formed by the two plates 40 and 42.

In the embodiment illustrated in FIG. 4, the contact elements 32, 34 of said one coupling head 12 are mounted in axially resilient manner and are biased toward the second plate 42. In contrast, the not shown contact elements of the other coupling head 12' are formed as rigid mating contacts. When the two coupling heads 12, 12' are connected together, the springs 50, 52 press the contact elements 32 and 34 of the coupling head 12 onto the rigid contact elements of the coupling head 12'. Thus it is provided for a reliable electrical contact between the contact elements.

Figure 5:
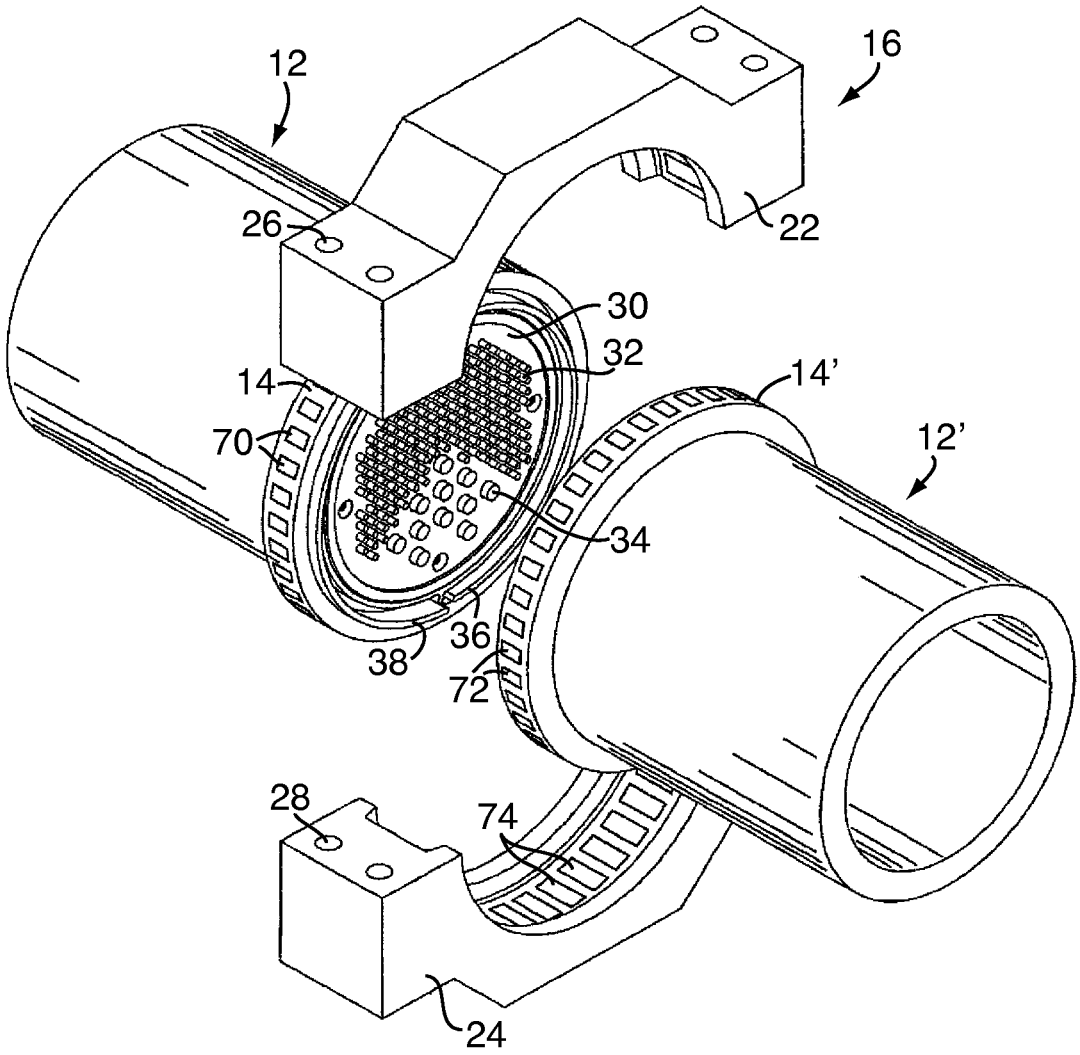
FIG. 5 shows a perspective view showing two coupling heads and a shell-type sleeve in a modified embodiment.

In FIG. 5 a variation of the embodiment shown in FIG. 2 is illustrated. In this variation, additional contact elements 70, 72 are provided at the outer surfaces of the annular flanges 14, 14'. Furthermore, bridge contacts 74 are disposed at the inner circumferential surfaces of the shell portions 22 and 24. The additional contact elements 70, 72 and the bridge contacts 74 are arranged such that each bridge contact 74 establishes an electrical connection between one of the contact elements 70 and one of the contact elements 72, when the coupling heads 12, 12' are connected together by the shell portions 22 and 24. Thereby the contact elements 70, 72 are preferably formed as spring contacts, which ensure a reliable electrical contact with the bridge contacts 74.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A middle buffer coupling for rail-bound vehicles, comprising:

two coupling halves to be coupled together attached to respective vehicle parts, each of said coupling halves comprising a coupling rod with a coupling head; and a connecting element for manually connecting the two coupling heads;

wherein each coupling head includes a plurality of electrical contact elements, the electrical contact elements being disposed in each coupling head for contacting with the electrical contact elements of the other respective coupling head when the two coupling halves are coupled together, and wherein each coupling rod is formed to be hollow and within each coupling rod electrical lines are routed, such that said electrical lines are positioned completely within the respective coupling rod and lead from the contact elements of the associated coupling head to the vehicle part to which the coupling halves comprising said coupling rods are attached.

2. The middle buffer coupling according to claim 1, wherein each coupling head has a contact carrier at the face side thereof facing the respective other coupling head, in which contact carrier the contact elements are arranged.

3. The middle buffer coupling according to claim 2, wherein the contact carrier of one of the two coupling heads is formed as male connector and the contact carrier of the other coupling head is formed as female connector for receiving the male connector.

4. The middle buffer coupling according to claim 2, wherein the contact elements of one of the two coupling heads are mounted in axially resilient manner in the contact carrier and are biased in the coupling direction and the contact elements of the other coupling head are rigidly mounted in the contact carrier.

5. The middle buffer coupling according to claim 4, wherein the contact carrier of said one coupling head comprises a first plate having a plurality of axial first bores and a second plate attached to the first plate having a plurality of axial second bores aligned to the first bores, wherein the diameters of the second bores are respectively smaller than the diameters of the associated first bores, and one of the contact elements and a biasing element are respectively arranged in the first bores;

wherein the respective contact element has an annular abutment and a contact head adjacent to the abutment, which is led through the associated second bore, and wherein the biasing element pushes the abutment onto the second plate in the coupling direction.

6. The middle buffer coupling according to claim 1, wherein each coupling head has an annular flange attached to the free end of the coupling rod and the connecting element is formed as shell-type sleeve, which surrounds the annular flanges lying adjacent to each other to connect the two coupling heads.

7. The middle buffer coupling according to claim 6, wherein the shell-type sleeve is formed from two uniform shell portions which can be connected together.

8. The middle buffer coupling according to claim 6, wherein at least a part of the contact elements of each coupling head is disposed at the outer surface of the annular flange and the shell-type sleeve includes bridge contacts at the inner surface thereof, which bridge contacts contact the contact elements disposed at the outer surface of the annular flanges.

9. The middle buffer coupling according to claim 8, wherein the contact elements arranged at the outer surface of the annular flange and/or the bridge contacts arranged at the inner surface of the shell-type sleeve are formed as contact springs.

10. The middle buffer coupling according to claim 6, wherein a part of the contact elements of each coupling head is intended for power transmission and another part for signal transmission, and one of the part of contact elements intended for power transmission and the part of contact elements intended for signal transmission are arranged at a face surface of the coupling head, while the respective other of the part of contact elements intended for power transmission and the part of contact elements intended for signal transmission are arranged at the outer surface of the annular flange.

11. The middle buffer coupling according to claim 1, wherein the electrical lines are crimped onto the contact elements.

12. The middle buffer coupling according to claim 1, wherein a part of the contact elements of each coupling head is intended for power transmission and another part for signal transmission.

13. The middle buffer coupling according to claim 1, wherein each coupling half comprises a housing part mounted in an articulated manner to the respective vehicle part, in which the corresponding coupling rod is resiliently received and that the electrical lines are led through the coupling rod and the housing part into the vehicle part.

14. The middle buffer coupling according to claim 13, wherein a buffer device is arranged in each coupling rod and/or in each housing part.

15. The middle buffer coupling according to claim 1, wherein each coupling head has at least one annular portion at the face surface thereof extending in the coupling direction, the annular height of which measured in the coupling direction varies in the circumferential direction, such that the annular portion fits on the annular portion of the respective other coupling head only in precisely one rotation position of the coupling heads with respect to each other.

* * * * *